United States Patent [19]

Botello

[11] Patent Number: 4,727,958

[45] Date of Patent: Mar. 1, 1988

[54] MECHANIC'S BODY SUPPORT DEVICE

[76] Inventor: Roger N. Botello, 4709 Candletree La., Austin, Tex. 78744

[21] Appl. No.: 930,900

[22] Filed: Nov. 17, 1986

[51] Int. Cl.[4] ..... B25H 5/00

[52] U.S. Cl. ..... 182/15; 182/116; 182/230

[58] Field of Search ..... 182/129, 116, 17, 15, 182/230

[56] References Cited

U.S. PATENT DOCUMENTS

| | | | |
|---|---|---|---|
| 2,969,123 | 1/1961 | Jamerson | 182/116 |
| 3,312,305 | 4/1967 | Waun | 182/15 |
| 3,493,225 | 2/1970 | Ceraldi | 182/131 |
| 3,976,155 | 8/1976 | Esch | 182/230 |
| 4,397,374 | 8/1983 | Rumage | 182/131 |
| 4,618,029 | 10/1986 | Lowry | 182/116 |

*Primary Examiner*—Reinaldo P. Machado
*Attorney, Agent, or Firm*—Gilden & Israel

[57] ABSTRACT

An automobile mechanic's body support includes a H-shaped mobile frame with an attached upstanding support platform. The support platform includes knee rests and a chest support with appropriate adjustment means being provided for positioning the various rests at selected heights. The chest support is mounted to a curved rod which allows the mechanic to position his body over a vehicle's engine.

9 Claims, 5 Drawing Figures

MECHANIC'S BODY SUPPORT DEVICE

BACKGROUND OF THE INVENTION

1. Field of the Invention

The present invention relates to mobile support devices, and more particularly pertains to a mobile automobile mechanic's body support which includes support platforms for the knees and torso of the mechanic so that he can work over the automobile's engine compartment.

2. Description of the Prior Art

As can be appreciated, automobile mechanics are subjected to substantial stresses and strains while leaning over automobile engine compartments to perform work on the engines contained therein. Typically, an automobile mechanic will utilize a vehicle's fender as a support. However, the fender typically only supports the lower torso of the mechanic, with his upper torso then extending outwardly over the engine compartment. This of course results in rapid fatigue due to the stress on the mechanic's lower back muscles. Currently, there are no specially designed support devices commercially available which would assist mechanics in the performing of their required work.

Although no special body support devices are presently available for purchase by mechanics, there has at least been a recognition of the need for such devices. For example, reference is made to U.S. Pat. No. 4,397,374, which issued to Rumage et al on Aug. 9, 1983. The Rumage et al patent discloses an auto mechanic's body support which includes a T-shaped mobile frame and rectangular tube members supported thereon. The support includes a platform for the mechanic to stand on and also a further platform for the mechanic to lie on. Both platforms may be adjustably repositioned so as to allow the mechanic's body weight to be distributed between the standing platform and the chest-rest platform. While being functional to achieve its desired purpose, it would appear that the Rumage et al body support has not met with commercial success. Such failure to achieve commercial success may be attributed to the fact that the support requires a mechanic to be in a continually standing position, i.e., his feet must be supported by the lower platform while his chest rests upon the elevated platform. In reviewing the specific shape of the Rumage et al device, this requirement for both standing and leaning upon the body support could result in an unexpected and unusual strain being experienced by the mechanic. More particularly, his legs would have to be completely extended so as to provide the angular force required to retain his torso on the upper support, which could result in substantial fatigue.

Accordingly, it can be appreciated that there is a continuing need for new and improved body supports which could be utilized by an automobile mechanic wherein such supports would eliminate substantially all experienced fatigue over an extended period of time. In this respect, the present invention substantially fulfills this need.

SUMMARY OF THE INVENTION

In view of the foregoing disadvantages inherent in the known types of mobile body supports now present in the prior art, the present invention provides an improved mobile body support wherein the same can be utilized by an automobile mechanic to support the weight of his torso while working over an engine compartment. As such, the general purpose of the present invention, which will be described subsequently in greater detail, is to provide a new and improved mobile body support which has all the advantages of the prior art mobile body supports and none of the disadvantages.

To attain this, the present invention essentially comprises a device that supports the mechanic's body as he leans over into an engine compartment to work on the engine contained therein. By supporting his full weight, the device relieves back, knee and other muscle strains, and frees the mechanic to use both of his hands for work. Basically, the invention comprises a H-shaped base with castered wheels at each of its four corners. The wheels are spring mounted, such that when weight is placed on the device, they are made inoperative, thereby to prevent an unexpected and undesired movement of the complete assembly.

A telescoping pole extends upwardly from a portion of the base frame structure, and the height of the pole can be adjusted by removable pins or a crank assembly. The upper part of this telescoping pole curves in an arc over the H-shaped base, while it further has two padded knee rests positioned on a lowermost portion. The upper ends of the pole include a large tee which supports a padded chest rest. In use, a mechanic needs only to slide the H-shaped base under the car adjacent to the engine compartment which then allows the arched upper support to extend outwardly over the engine. With his knees placed on the lower rest, which immobilizes the device, the mechanic then only needs to lay his chest on the upper rest and proceed with his work. In this respect, the weight of the mechanic's body is fully supported by the invention, thus making it possible for him to proceed freely and comfortably with his work.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mobile body support which has all the advantages of the prior art mobile body supports and none of the disadvantages.

It is another object of the present invention to provide a new and improved mobile body support which may be easily and efficiently manufactured and marketed.

It is a further object of the present invention to provide a new and improved mobile body support which is of a durable and reliable construction.

An even further object of the present invention is to provide a new and improved mobile body support which is susceptible of a low cost of manufacture with regard to both materials and labor, and which accordingly is then susceptible of low prices of sale to the consuming public, thereby making such mobile body supports economically available to the buying public.

Still yet another object of the present invention is to provide a new and improved mobile body support which provides in the apparatuses and methods of the prior art some of the advantages thereof, while simultaneously overcoming some of the disadvantages normally associated therewith.

Still another object of the present invention is to provide a new and improved mobile body support which is particularly well adapted for use by an automobile mechanic.

Yet another object of the present invention is to provide a new and improved mobile body support which will support the complete body weight of a mechanic while allowing him to maintain his legs in a restful position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
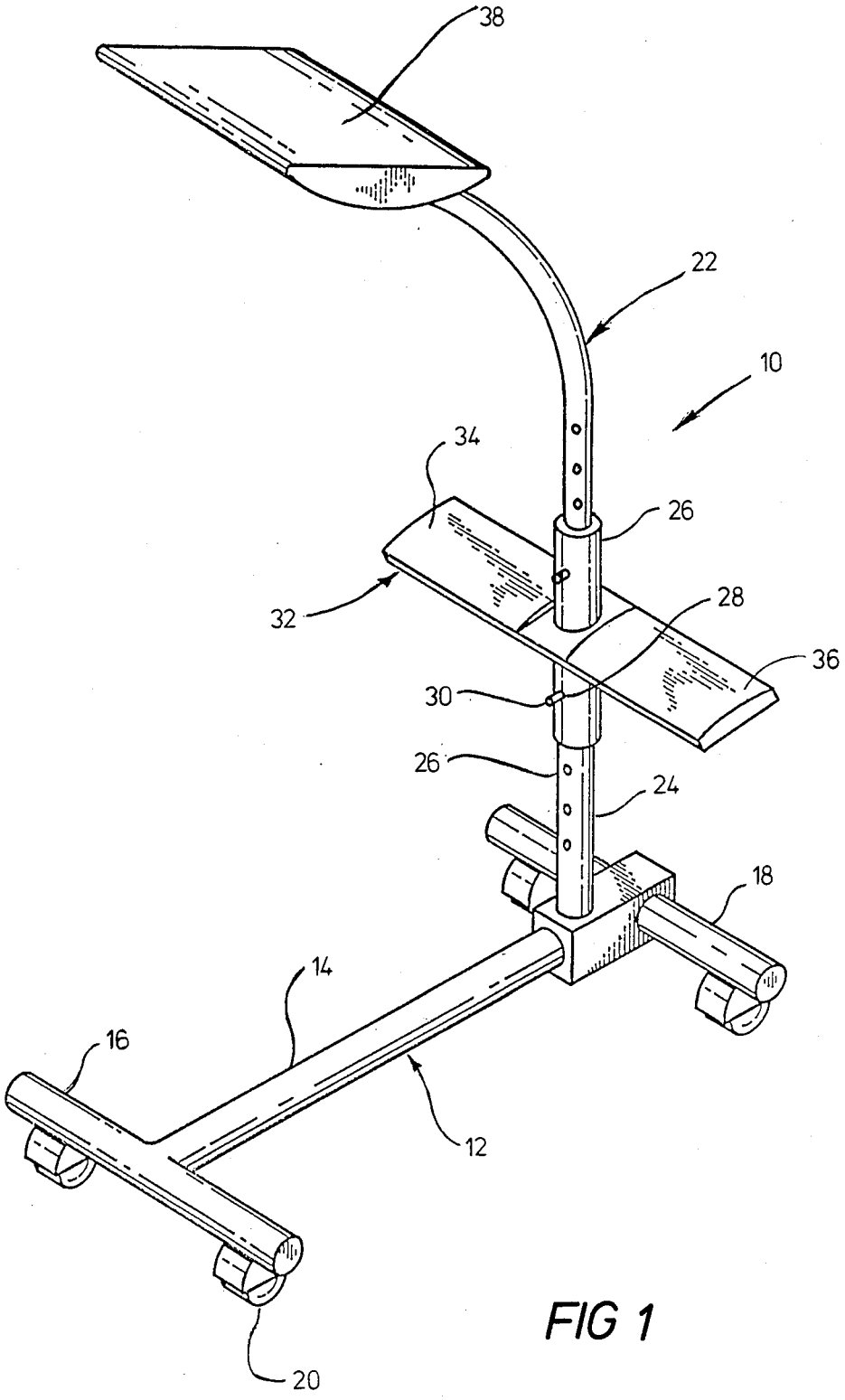
FIG. 1 is a perspective view of the mechanic's body support device comprising the present invention.

With reference now to the drawings, and in particular to FIGS. 1–5 thereof, a new and improved mobile mechanic's body support embodying the principles and concepts of the present invention and generally designated by the reference numeral 10 will be described.

More specifically, it will be noted that the mobile body support 10 essentially comprises a H-shaped base frame structure 12 which includes a center pole portion 14 and integrally attached T-members 16, 18 at respective opposite ends thereof. A plurality of caster wheels 20 are mounted at four corners of the frame structure 12, with these wheels being spring mounted so that they are locked against rotation when a substantial weight is positioned on the support 10.

Mounted proximate the T-member 18 is an upstanding support member 22. The upstanding support member 22 includes a lower upstanding support 24 which telescopingly receives an upper tubular support member 26 so as to provide height adjustment for the entire assembly. In this respect, the lower tubular support 24 is provided with a plurality of through-extending apertures 26, while the upper support 22 may be provided with a single through-extending aperture 28 through which a locking pin 30 may be removably positioned. As such, the through-extending aperture 28 maybe aligned with any one of the through-extending apertures 26 before an insertion of the locking pin 30, thereby to effect the desired height adjustment of the upstanding support member 22.

Further illustrated in the drawings is a knee support member 32 which is attached to and extends outwardly from both sides of the tubular support member 26, with each of the respective ends 34, 36 of the knee support member being covered with a padded foam material. In this regard, each of these ends 34, 36 are designed to support one of the knees of a user during a use of the body support 10.

Figure 2:
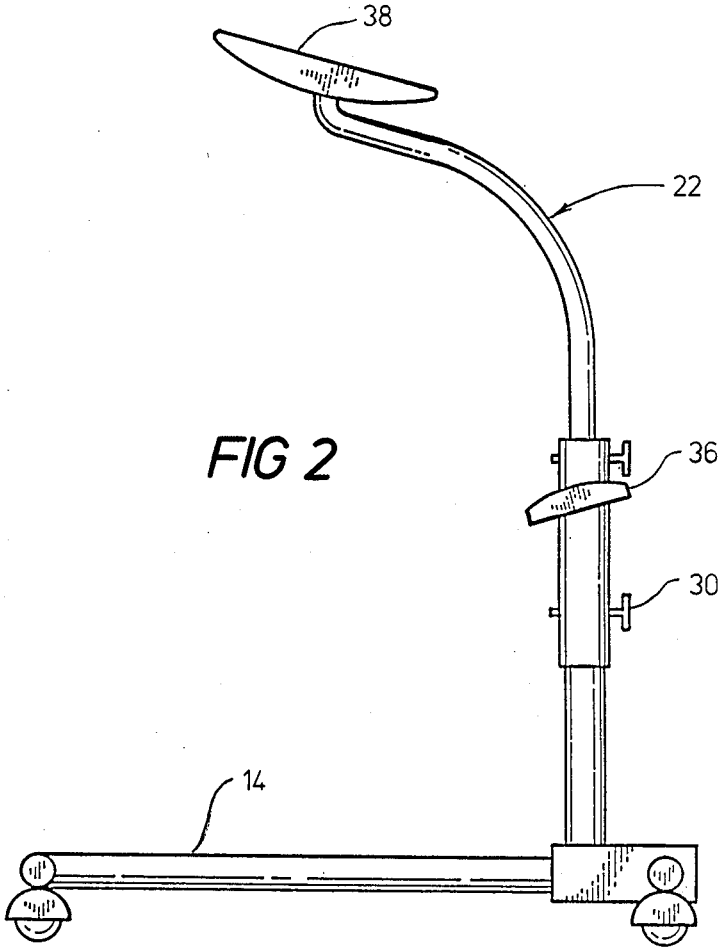
FIG. 2 is a typical side elevation view of the invention.
Figure 3:
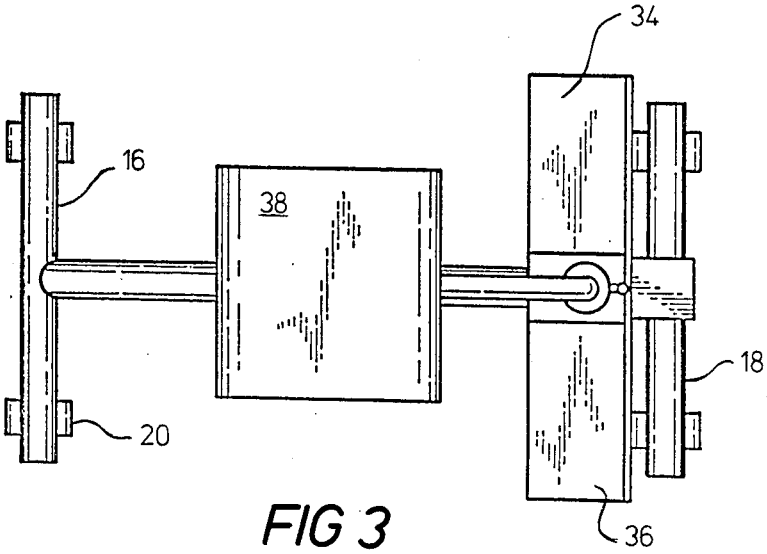
FIG. 3 is a top plan view of the invention.
Figure 4:
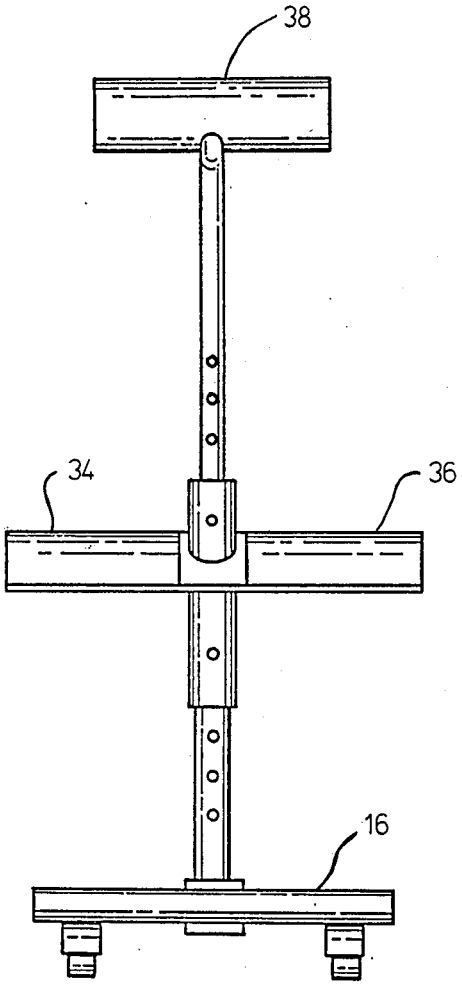
FIG. 4 is a left end elevation view of the invention.
Figure 5:
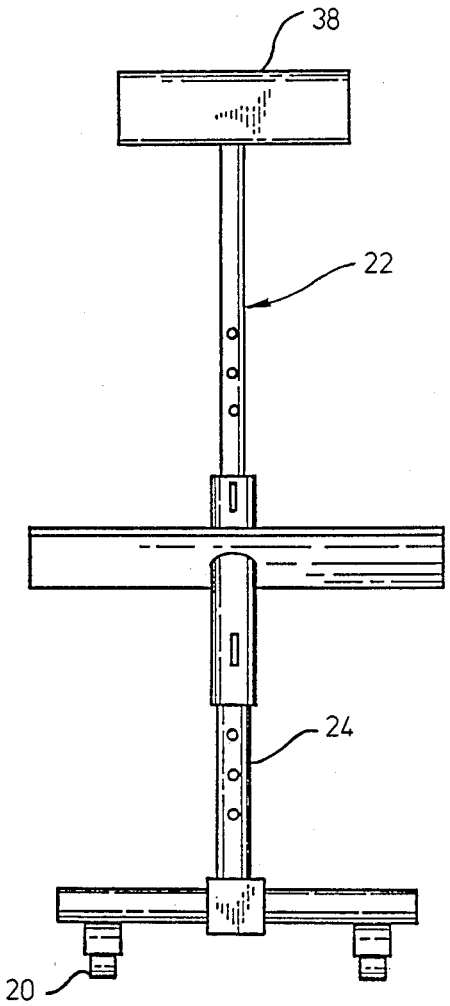
FIG. 5 is a right end elevation view of the invention.
Figure 6:
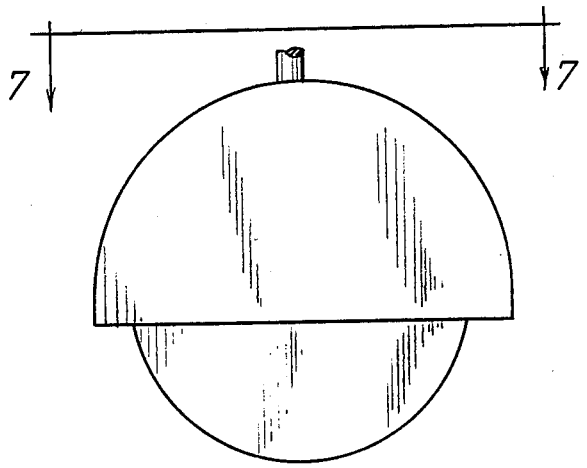
Figure 7:
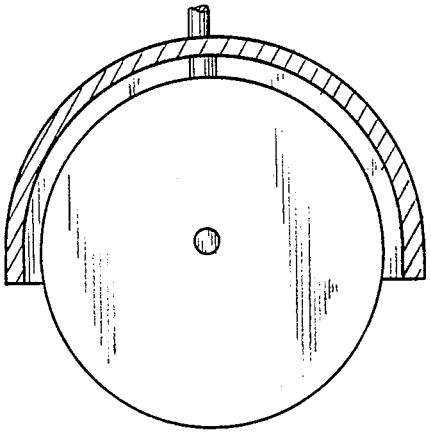
Figure 8:
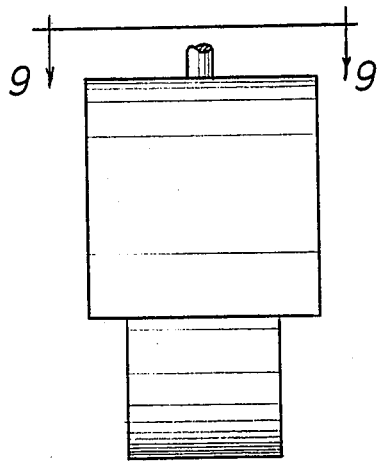
Figure 9:
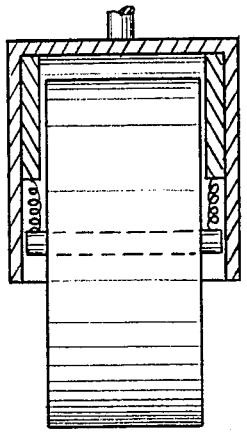

As best illustrated in FIGS. 1 and 2 of the drawings, the upper tubular support member 26 is of a curvilinear shape and curves inwardly over the center pole member 14 forming a part of the base frame structure 12. A topmost portion of the tubular support 26 is provided with a planar shaped foam padded support member 38. The support member 38 may be of any desired shape and size to accommodate the supporting of the upper torso of a user. Both the support member 38, as well as the knee supports 34, 36, will typically comprise rigid members covered by a soft foam material with a vinyl covering or the like then being used to protect the support pads. If desired, the support member 38 could be adjustably mounted to the tubular member 26, thereby to facilitate angular and heightwise positioning of the padded member upon the tubular member support.

With respect to the manner of usage and operation of the present invention, the same should be apparent from the above discussion. However, a brief summary thereof will be provided. In this respect, a mechanic needs only to slide the H-shaped base frame structure 12 under a car adjacent to the engine compartment. The height, angle, etc. of the chest and knee rest 38, 34, 36, respectively, are adjusted to the desired position. The mechanic then places his knees of the rests 34, 36, while the weight of his body then serves to immobilize the mobile support 10 due to the locking of the castered wheels 20. The mechanic then lays his chest on the chest support 38 and proceeds with his work. The weight of the mechanic's body is fully supported by the device 10, making it possible for him to proceed freely and comfortably with engine maintenance.

While the above described invention has been illustrated in one preferred embodiment, many variations are within the intent and purview of the invention. For example, heightwise adjustment of the upper tubular support 26 could be accomplished by means of a crank assembly. Further, the device 10 could be modified so that the knee supports 34, 36 could be removed or lowered to allow usage of the chest support 38, in a standing position. The chest support 38 and its extender 26 could be removed completely from the system and modified so as to attach to the fender of an automobile, a sink, table, fence, etc. This latter version of the invention could accommodate the needs of surgeons, dish washers, animal groomers, etc. Additionally, the entire system could be modified so as to be selectively adjusted to a position close to the ground surface, thereby to facilitate the pulling of weeds, painting baseboards, or the like. A hydraulic hand pump could be installed in the main tube in lieu of the pin or crank assembly, and a temporary storage space could be added below the knee supports 34, 36 in order to store tools or other necessities therein. A light could be attached to the bottom of the chest support 38 to improve background illumination.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved mechanic's body support comprising:

base support means;

upstanding support means attached to said base support means;

knee support means attached to and extending laterally outwardly from said upstanding support means; and torso support means attached to a topmost portion of said upstanding support means.

2. The new and improved mechanic's body support as described in claim 1, wherein said knee support means is adjustably attached to said upstanding support means.

3. The new and improved mechanic's body support as described in claim 1, wherein said torso support means is adjustably attached to said topmost portion of said upstanding support means.

4. The new and improved mechanic's body support as described in claim 1, wherein said base support means comprises a H-shaped frame structure.

5. The new and improved mechanic's body support as described in claim 4, wherein said H-shaped base frame structure includes castered wheels to facilitate mobility.

6. The new and improved mechanic's body support as described in claim 5, wherein said castered wheels are spring loaded thereby to be lockable in position in response to a sensed weight.

7. The new and improved mechanic's body support as described in claim 6, wherein said knee support means is adjustable in height.

8. The new and improved mechanic's body support as described in claim 7, wherein height adjustment of said knee support means is provided by a pin and aperture arrangement.

9. The new and improved mechanic's body support as described in claim 8, wherein said upstanding support means is of a curvilinear shape with said torso support means being positioned substantially over a center portion of said base support means.

* * * * *